US007980803B2

(12) United States Patent
Brandstätter et al.

(10) Patent No.: US 7,980,803 B2
(45) Date of Patent: Jul. 19, 2011

(54) SYSTEM FOR RELEASING BULK MATERIAL, AND CONTAINER HAVING SUCH A BULK-MATERIAL-RELEASING SYSTEM

(75) Inventors: Johann Brandstätter, Furth (AT); Attila Matrahazi, Weissenbach/Triesting (AT)

(73) Assignee: Starlinger & Co Gesellschaft m.b.H, Vienna (AT)

( * ) Notice: Subject to any disclaimer, the term of this patent is extended or adjusted under 35 U.S.C. 154(b) by 438 days.

(21) Appl. No.: 12/158,639

(22) PCT Filed: Dec. 18, 2006

(86) PCT No.: PCT/AT2006/000520

§ 371 (c)(1),
(2), (4) Date: Jun. 20, 2008

(87) PCT Pub. No.: WO2007/070903

PCT Pub. Date: Jun. 28, 2007

(65) Prior Publication Data

US 2008/0292447 A1 Nov. 27, 2008

(30) Foreign Application Priority Data

Dec. 21, 2005 (AT) ..... A 2050/2005

(51) Int. Cl.
*B65G 65/30* (2006.01)

(52) U.S. Cl. ..... 414/293; 414/299; 222/485; 222/548

(58) Field of Classification Search ..... 414/299, 414/293; 222/485, 548; 193/9, 10
See application file for complete search history.

(56) References Cited

U.S. PATENT DOCUMENTS

| | | | | |
|---|---|---|---|---|
| 1,618,118 | A * | 2/1927 | Vartabedian | 222/129 |
| 2,740,564 | A | 4/1956 | Altstaedt | |
| 3,863,811 | A | 2/1975 | Fisher et al. | |
| 5,901,886 | A * | 5/1999 | Grindstaff et al. | 222/557 |
| 6,109,486 | A * | 8/2000 | Lee et al. | 222/485 |
| 2002/0148861 | A1 * | 10/2002 | Koehler | 222/485 |

FOREIGN PATENT DOCUMENTS

| | | |
|---|---|---|
| DE | 502763 | 7/1930 |
| EP | 1491469 A1 | 12/2004 |
| FR | 2128058 | 10/1972 |

* cited by examiner

*Primary Examiner* — Michael S Lowe
(74) *Attorney, Agent, or Firm* — Workman Nydegger

(57) ABSTRACT

A system for the delivery of bulk material, in particular a free-flowing bulk material such as, e.g., plastic granules, comprises a discharge base (7) having recesses (8), with a discharge opening (9) being formed in each of the recesses (8), and a cover plate (11) which is arranged on the outflow side of the discharge base (7) at a distance (h) from the same, with the cover plate (11) having openings (12) which are arranged essentially in the same pattern as the discharge openings (9) of the discharge base (7). The cover plate (11) and the discharge base (7) are movable relative to each other between an opened condition in which the discharge openings (9) of the discharge base (7) and the openings (12) of the cover plate (11) overlap each other at least partially, preferably being congruent, and a closed condition in which the discharge openings (9) of the discharge base (7) exhibit such an axial offset (s) from the openings (12) of the cover plate (11) that no overlap is produced.

19 Claims, 1 Drawing Sheet

FIG.1
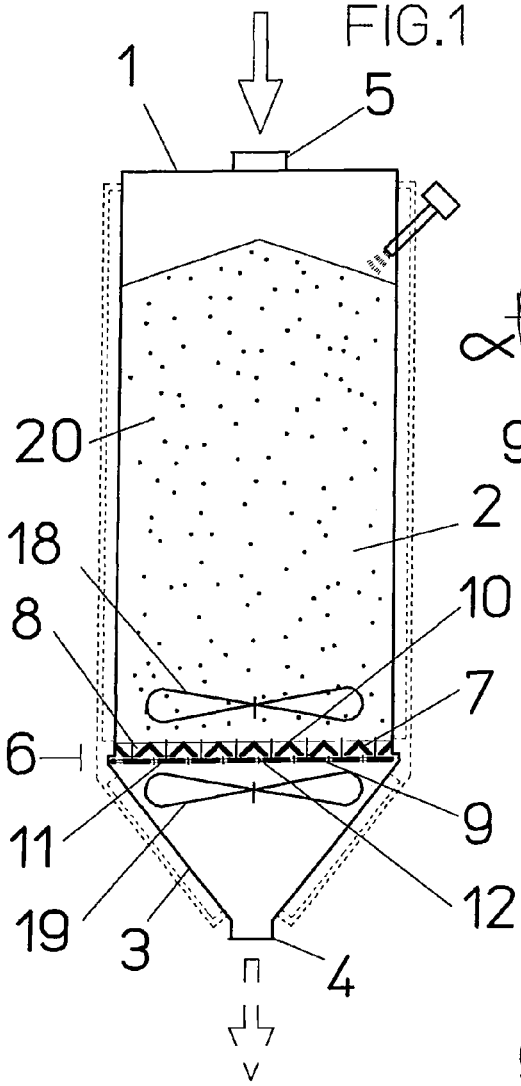
FIG.3A
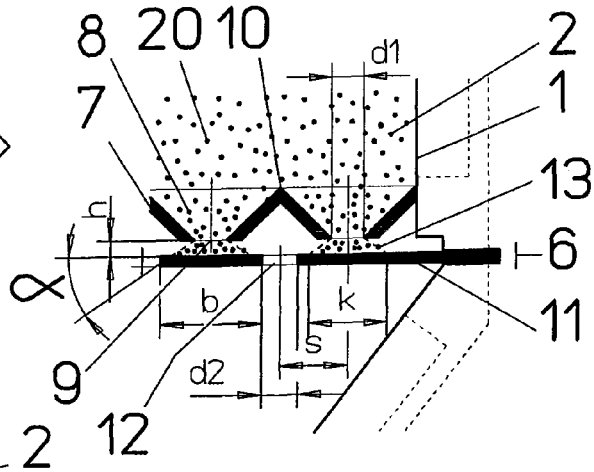
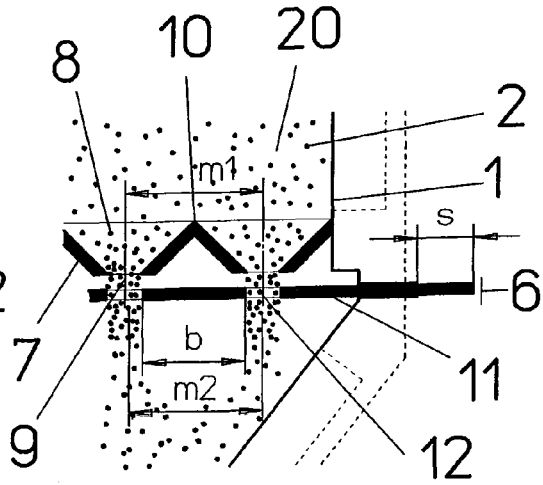
FIG.3B
FIG.2
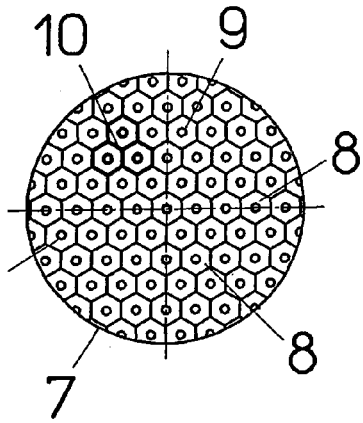

SYSTEM FOR RELEASING BULK MATERIAL, AND CONTAINER HAVING SUCH A BULK-MATERIAL-RELEASING SYSTEM

The invention starts out from a system for the delivery of bulk material, in particular a free-flowing bulk material such as, e.g., granules, from a container such as, for example, a bin, according to the preamble of claim 1, as well as from a container comprising such a bulk material delivery system according to claim 10.

Devices for the metered discharge of various kinds of bulk materials from a magazine are known in a plurality of embodiments. From published patent application DE 44 09 105 A1, for example, a container is known wherein a free-flowing bulk material can be discharged from a discharge aperture through a cellular wheel sluice in that bulk material flows, in defined quantities, into the wheel's cells and is then delivered by rotating the wheel.

Furthermore, it is known to produce sluices in storage vessels using at least one, usually several, slides arranged so as to be offset against each other and/or opening in a mutually offset manner. Thereby, the storage vessels generally exhibit a conical region tapering toward the sluice, by means of which conical region the sluice's size and hence, for example, the weight forces bearing on the slides are reduced.

The above-mentioned solutions are disadvantageous particularly in that, on the inflow side of the sluice, a core flow emerges due to the conical shape of the magazine, as a result of which core flow the bulk material located in the centre of the magazine runs off faster than that located on the walls. Thus, a portion of the bulk material remains longer in the storage vessel. This is disadvantageous especially in case of temperature-critical fillings of a storage vessel such as, e.g., PET-granules in an SSP-storage vessel, since irregular residence times could, for example, lead to nonuniform properties of the bulk material or a nonuniform temperature distribution could arise in the bulk material.

Thus, it is an object of the present invention to provide a system for the removal of bulk material from an arbitrarily shaped container, by means of which it is possible to uniformly withdraw the bulk material, to prevent a removal of bulk material involving a core flow, thus homogenizing the residence time of the bulk material in the container.

With regard to the system, said object is achieved by means of the system designed according to the invention for the delivery of bulk material from a storage vessel according to claim 1, and, with regard to the container, said object is achieved by means of a container comprising such a bulk material delivery system.

Thereby, it is envisaged to combine a discharge base having recesses with discharge openings formed therein with a cover plate arranged on the outflow side of the discharge base and spaced apart from the same. The cover plate has openings which are arranged essentially in the same pattern as the discharge openings of the discharge base and is arranged so as to be slidable relative to the discharge base, whereby the openings of the cover plate and the discharge openings of the discharge base can be brought into alignment for the delivery of bulk material. A delivery of bulk material which is free from a core flow can result from this measure according to the invention.

Advantageous advanced embodiments of the invention are indicated in the subclaims.

Advantageously, an indirect closure of the discharge openings is achieved by the heap formation of the bulk material on the cover plate, whereby there is no need to fear jamming of and damage to the bulk material, respectively, because of the distance between the discharge base and the cover plate.

Furthermore, it is advantageous that the centre distance and the number of openings are equally large in the discharge base and in the cover plate. A distance between the discharge base and the cover plate is thereby chosen such that a base diameter of the heaps of bulk material that are forming is smaller than the centre distance of the respective openings. Thus, a secure closure without any complicated facilities is rendered possible.

In a preferred embodiment of the invention, the bulk material delivery system extends basically across the entire ground area of the storage space. This prevents the formation of core flows of bulk material in the storage space.

Advantageously, the bulk material delivery system is arranged essentially vertically with respect to a longitudinal axis of the container, whereby simple discharge is rendered feasible.

In the following, the invention is illustrated in further detail in the figures, on the basis of a preferred exemplary embodiment. Therein, FIG. 1 shows a strongly schematized sectional view of an exemplary embodiment of a storage vessel provided with a bulk material delivery system designed according to the invention, FIG. 2 shows a top view of a discharge base of the bulk material delivery system according to the invention, FIG. 3A shows an enlarged illustration of a detail of the bulk material delivery system designed according to the invention in a closed condition, and FIG. 3B shows an enlarged illustration of a detail of the bulk material delivery system designed according to the invention in an opened condition during the removal of bulk material.

FIG. 1 shows, in a strongly schematized sectional illustration, a container 1 which, in the illustrated exemplary embodiment, comprises a storage space 2 having an essentially cylindrical cross-section and tapers conically, in an outflow direction, toward a funnel 3 for the delivery of bulk material 20 located in the container 1, from which funnel a portion of the bulk material 20 can be withdrawn through a discharge aperture 4. The container 1 can be charged with the bulk material 20 through a feed opening 5.

In conventional containers 1, the bulk material 20 occupies the entire available space including the conical region of the funnel 3 in the container 1. Accordingly, if bulk material 20 is removed through the centered discharge aperture 4, the emptying of the container 1 proceeds in an irregular manner, since a core flow forms as a result of which bulk material 20 stored centrally is discharged faster than bulk material 20 located close to the edge. As a consequence, residence times in the container 1 are frequently substantially longer for bulk material 20 close to the edge than for bulk material 20 stored centrally.

So as to be able to counter the above-illustrated problems, it is provided according to the invention that the bulk material 20 is withdrawn already before the conical region of the funnel 3 via a suitable bulk material delivery system 6 so that the bulk material 20 present in the container 1 can be discharged uniformly across the entire cross-section of the container 1.

In the following, the bulk material delivery system 6 designed according to the invention is illustrated in further detail in terms of its construction and mode of operation, taking reference to FIGS. 2 and 3A to 3B.

As can be seen in FIG. 1, a discharge base 7 is provided in the bulk material delivery system 6, which discharge base is arranged generally vertically with respect to a longitudinal axis of the container 1, i.e., like a floor therein, and seals the storage space 2 of the container 1, which, in the exemplary embodiment, is essentially cylindrical.

The discharge base 7 has recesses 8 which each are provided with discharge openings 9. The recesses 8 are formed in the discharge base 7, for example, by milling, pressing, punching or by similar appropriate methods. The recesses 8 are shaped conically and taper in a funnel-shaped manner in a flow direction of the bulk material 20.

In FIG. 2, the discharge base 7 is illustrated in a strongly schematized top view. The recesses 8 are thereby arranged as closely together as possible and are formed in such a way that no raised residual areas are left between the recesses 8. In the present embodiment, this is achieved by a hexagonal design of the recesses 8, with adjacent recesses 8, in each case, having a common geometrical intersection line 10 which is deflected toward the centre of the line. As a result, only a small amount of bulk material 20 is deposited on the residual areas 10 so that the all-over discharge of bulk material 20 is thereby not impaired. So as to avoid flat residual areas between the recesses, generally, a polygonal base area of the recesses 8 is beneficial, which base area can merge, in a downward direction, into a cone. Thereby, a honeycomb arrangement of recesses is rendered feasible.

The number $n_1$ of discharge openings 9 is arbitrary, however, in the present exemplary embodiment, it is in an order of magnitude of approx. 80 for reasons which will be specified hereinbelow, with each of the discharge openings 9 having an opening width $d_1$ of approx. 30 mm. A centre distance $m_1$ to the adjacent recesses 8 amounts to approx. 100 mm.

The discharge base 7 is paired with a cover plate 11 which is provided with a distribution of openings 12 identical to that of the discharge base 7 and is spaced apart from the same by a distance h. However, the openings 12 of the cover plate 11 are not arranged in recesses but are formed in the cover plate 11 merely by punching or by another appropriate method and exhibit an edge distance b toward each other. The number of openings 12 amounts to $n_2$, the opening width is $d_2$, and a centre distance is $m_2$. Thereby, the following applies to the discharge openings 9 and the openings 12: $n_1=n_2$; $m_1 \approx m_2$ and $d_1 \approx d_2$.

The cover plate 11 is arranged so as to be slidable relative to the discharge base 7. In FIGS. 3A and 3B, the slidability is indicated by s and is construed such that, in a closed condition of the bulk material delivery system 6 according to FIG. 3A, the openings 12 of the cover plate 11 do not overlap with the discharge openings 9 of the discharge base 7. In addition, a distance of the openings 12 of the cover plate 11 is determined in that, in an opened condition according to FIG. 3B, each discharge opening 9 of the discharge base 7 is paired with an opening 12 of the cover plate 11 so that the discharge openings 9 dimensioned with a similar diameter and the openings 12 are roughly congruent.

The reasons for choosing the number of recesses 8 or discharge openings 9, respectively, as well as the dimensioning thereof lie in the nature and flowability, respectively, of the bulk material 20. If said material has a grain size of approx. 3 to 4 mm and if the discharge openings 9 and the openings 12, respectively, are appropriately dimensioned in the closed condition of the bulk material delivery system 6, as illustrated in FIG. 3A, a residual discharge onto the cover plate 11 can indeed be observed, however, based on the grain size, a heap 13 with a base diameter k is formed, which achieves a stable value in case of a particular slope angle $\alpha$, the size of which depends, among other things, on the wall inclination of the recesses 8, the flowability of the bulk material 20 and the vertical distance h of the cover plate 11 from the discharge base 7, and will thus result in a complete closure of the discharge openings 9 via a so-called indirect closure. The discharge of the bulk material 20 can thereby be controlled reliably by displacing the cover plate 11 relative to the discharge base 7. Thus, the edge distance b of the openings 12 simply needs to be chosen such that the base diameter k of the heaps 13 formed is smaller than the edge distance b of adjacent openings 12 of the cover plate 11 in order to achieve the complete closure of the bulk material delivery system 6.

In the illustrated exemplary embodiment, in the closed condition of the bulk material delivery system 6, the openings 12 of the cover plate 11 and the discharge openings 9 of the discharge base 7 are, in each case, displaced relative to an opened condition by a quantity s, with s corresponding to half the centre distance ($m_1$ or $m_2$, respectively) of the discharge openings 9 and the openings 12, respectively, so that, in a closed condition of the bulk material delivery system 6, the openings 12 of the cover plate 11 are positioned between the recesses 8 of the discharge base 7. Hence, the cover plate 11 has to be displaced relative to the discharge base 7 by quantity s or $m_1/2$ or $m_2/2$, respectively, in order to align the openings 12 with the discharge openings 9 for discharging a defined amount of bulk material 20.

In the exemplary embodiment, the discharge of the bulk material 20 from the container 1 is thus initially effected via the discharge openings 9 and the openings 12 of the cover plate 11 into the funnel 3, from which the discharged amount is finally delivered through the discharge aperture 4. Hence, a uniform residence time of the bulk material 20 in container 1 is ensured so that the homogeneity of the bulk material 20 is not adversely affected, for example, in terms of the temperature and, resulting therefrom, the consistency thereof.

The shape of the storage space 2 is thereby not limited to a cylindrical storage space 2, other shapes of containers 1 are conceivable as well. The bulk material delivery system 6 can, in particular, also be used in a stand-alone fashion so that the bulk material 20 is simply poured as a heap onto the appropriately dimensioned discharge base 7.

Furthermore, it should be mentioned that, in particular with bulk materials having poor flowability such as, e.g., flakes, it might be favourable if an agitator 18 is provided above the discharge base 7, as schematically illustrated in FIG. 1. Another agitator 19 can be arranged underneath the cover plate 11 in order to move the bulk material passed through the bulk material delivery system 6 toward the discharge aperture 4. In this case, the funnel 3 can possibly be omitted.

A device for controlling the cover plate 11, which, for reasons of simplicity, is not illustrated further in the figures, can thereby be designed in any fashion, for example, in the shape of an electric motor or of another suitable actuating unit.

Furthermore, it should be mentioned that the system according to the invention for the delivery of bulk material is not limited to the above-described translational motion between the cover plate and the discharge base. Rather, the cover plate and the discharge base can also be twistable relative to each other about an axis of rotation. With such an embodiment, it must be kept in mind, however, that the shape and the size of the holes must change with an increasing distance from the axis of rotation in order to ensure a uniform delivery of the bulk material.

Furthermore, the system according to the invention for the delivery of bulk material is not limited to a flat plate shape for the discharge base. The discharge base and the cover plate can, for example, also be shaped like spherical caps.

The invention is not limited to the illustrated exemplary embodiment. With appropriate dimensioning, the invention is particularly applicable to any kind of bulk material 20. All features of the invention can be combined arbitrarily.

The invention claimed is:

1. A system for the delivery of bulk material, the system comprising:

a discharge base in which discharge openings are formed; and a cover plate which is arranged on the outflow side of the discharge base at a non-zero distance (h) from the same, with the cover plate having openings which are arranged essentially in the same pattern as the discharge openings of the discharge base, wherein:

the cover plate and the discharge base are movable relative to each other between an opened condition in which the discharge openings of the discharge base and the openings of the cover plate overlap each other at least partially, preferably being congruent, and a closed condition in which the discharge openings of the discharge base exhibit such an axial offset(s) from the openings of the cover plate that no overlap is produced;

the discharge base has recesses which preferably are shaped essentially conically, with a discharge opening being formed in each of the recesses; and the distance (h) between the discharge base and the cover plate as well as a centre distance and a diameter of the openings of the cover plate are chosen such that a base diameter of heaps of bulk material forming on the cover plate in the closed condition of the bulk material delivery system is smaller than the smallest edge distance between adjacent openings in the cover plate.

2. A bulk material delivery system according to claim 1, wherein the cover plate and the discharge base are displaceable relative to each other.

3. A bulk material delivery system according to claim 1, wherein the cover plate and the discharge base are twistable relative to each other.

4. A bulk material delivery system according to claim 1, wherein the discharge base has a plate-shaped design.

5. A bulk material delivery system according to claim 1, wherein the recesses in the discharge base are arranged without flat areas in-between.

6. A bulk material delivery system according to claim 1, wherein a diameter of the openings of the cover plate is at least as large as a diameter of the discharge openings of the discharge base.

7. A bulk material delivery system according to claim 6, wherein a number and a centre distance of the openings of the cover plate correspond to a number and a centre distance of the discharge openings of the discharge base.

8. A bulk material delivery system according to claim 1, wherein, in the closed condition of the bulk material delivery system, the openings of the cover plate exhibit an offset relative to the discharge openings of the discharge base, which offset corresponds to half the centre distance of the discharge openings and the openings.

9. A bulk material delivery system according to claim 1, wherein the discharge openings are circular.

10. A bulk material delivery system according to claim 1, wherein the recesses have a polygonal base area.

11. A bulk material delivery system according to claim 1, wherein the recesses merge, in a downward direction, into a cone.

12. A bulk material delivery system according to claim 1, wherein the recesses are arranged in a honeycombed fashion.

13. A container for the storage of bulk material, wherein the container comprises a storage space which can be filled with the bulk material via a feed opening, wherein the storage space has, at its bottom end, a bulk material delivery system according to claim 1.

14. A container according to claim 13, wherein the bulk material delivery system extends basically across the entire ground area of the storage space.

15. A container according to claim 14, wherein the storage space is shaped like a hollow cylinder or prism.

16. A container according to claim 13, wherein the container comprises a funnel with a discharge aperture on the outflow side of the bulk material delivery system.

17. A container according to claim 13, wherein the bulk material delivery system is arranged essentially vertically with respect to a longitudinal axis of the container.

18. A container according to claim 13, wherein an agitator is provided above the discharge base.

19. A container according to claim 13, wherein an agitator is provided underneath the cover plate.

* * * * *